United States Patent [19]

Fournier

[11] Patent Number: 4,638,857

[45] Date of Patent: Jan. 27, 1987

[54] VERTICAL TUBE HEAT EXCHANGER PANEL FOR WASTE-RECOVERY BOILERS SUCH AS BLACK LIQUID BOILERS OR HOUSEHOLD WASTE INCINERATOR FURNACES, AND METHODS OF MANUFACTURE

[75] Inventor: Jean Fournier, Rochefort En, France

[73] Assignee: Stein Industrie, France

[21] Appl. No.: 741,335

[22] Filed: Jun. 5, 1985

[30] Foreign Application Priority Data

Jun. 5, 1984 [FR] France ..... 84 08787

[51] Int. Cl.[4] ..... F22B 37/24

[52] U.S. Cl. ..... 165/162; 165/171; 122/6 A; 122/510

[58] Field of Search ..... 165/171, 162; 122/6 A, 122/510

[56] References Cited

U.S. PATENT DOCUMENTS

| | | | |
|---|---|---|---|
| 2,081,970 | 6/1937 | Alther | 165/171 |
| 2,243,402 | 5/1941 | Trainer et al. | 122/6 A |
| 2,705,877 | 4/1955 | King | 165/171 |
| 2,997,069 | 8/1961 | Bisbee | 138/114 |
| 3,221,135 | 11/1965 | Maier, Jr. | 219/137 R |
| 3,357,408 | 12/1967 | Patterson | 122/6 A |

FOREIGN PATENT DOCUMENTS

| | | | |
|---|---|---|---|
| 1441437 | 6/1976 | United Kingdom | 122/6 A |

*Primary Examiner*—William R. Cline
*Assistant Examiner*—Richard R. Cole
*Attorney, Agent, or Firm*—Sughrue, Mion, Zinn, Macpeak, and Seas

[57] ABSTRACT

A heat exchanger panel having vertical tubes (1, 2) which form loops between an inlet (1A) and an outlet (1B) via which they are suspended from a rigid structure (3, 4), and intended to come into contact via their outer surfaces with a soot-laden gas characterized in that its tubes are separated from one another at a pitch which is a little greater than their diameter, in that the tubes of the central portion are interconnected by fins, and in that the end tubes directly connected to the suspension structure are fixed to one another and to the nearest adjacent tube by short members (14, 15) welded on either side to adjacent tubes (21, 22, 23) at a level below that of the top loops of the panel, and are connected to one another and to the adjacent tube below the fixing members by fins (26).

6 Claims, 8 Drawing Figures

VERTICAL TUBE HEAT EXCHANGER PANEL FOR WASTE-RECOVERY BOILERS SUCH AS BLACK LIQUID BOILERS OR HOUSEHOLD WASTE INCINERATOR FURNACES, AND METHODS OF MANUFACTURE

FIELD OF THE INVENTION

The present invention relates to a heat exchanger panel comprising a plurality of vertical tubes which are interconnected alternately by top loops and by bottom loops to extend in a sinuous path from an inlet to an outlet, said panel being suitable for being suspended from a rigid structure via said inlet and said outlet, and the tubes being intended to come into contact via their outer surfaces with a soot-laden gas. The invention also extends to methods of manufacturing such a panel.

BACKGROUND OF THE INVENTION

When a panel of this type is used for exchanging heat with a soot-laden gas (such as the gas from incinerating papermaking black liquor or household waste) flowing outside the tubes, and particularly when the tubes are spaced at a pitch (distance between the tube axes) which is relatively large (e.g. twice the tube diameter), deposits of soot build up fairly rapidly between the tubes. These deposits reduce the heat exchange coefficient and sometimes cause heavy corrosion of the tubes, and they are difficult to remove by steam-jet sweeping.

To remedy these difficulties, panels of tubes have been used in which the spacing is very small (with the pitch being only a few mm greater than the tube diameter), by holding the tubes to one another by means of small rings welded from place to place therebetween. Such panels are easier to clean, but this disposition requires numerous manual welds, and these welds do not stand up over long periods of time to the stresses due to temperature differences between the tubes and to forces acting on the panels. The welds then given rise to cracks and leaks from the tubes.

Published French patent specification No. 1 418 565 describes a heat exchanger panel in which the tubes are close to one another and are interconnected by fins. The welds between fins and the end tubes suffer similarly from stresses due to temperature differences between tubes and to the weight of the central portion of the panel, and are therefore also likely to give rise to cracks and leaks from the tubes.

Preferred embodiments of the present invention provide a panel for exchanging heat with a soot-laden gas, which panel is easy to clean of soot deposits, and is simultaneously easy to manufacture, is capable of mechanized manufacture, and does not have weaknesses at the welds.

SUMMARY OF THE INVENTION

The present invention provides a heat exchanger panel comprising a plurality of vertical tubes which are interconnected alternately by top loops and by bottom loops to extend in a sinuous path from an inlet to an outlet, said panel being suitable for being suspended from a rigid structure via said inlet and said outlet, and the tubes being intended to come into contact via their outer surfaces with a soot-laden gas, wherein adjacent vertical tubes are separated from one another at a pitch which is a little greater than their diameter and are interconnected by fins, and wherein the end ones of said tubes which are directly suspendable from said rigid structure are fixed to one another and to the immediately adjacent tube which is not directly suspendable therefrom by short fixing members welded on either side to adjacent tubes at a level which is below the level of the top loops of the panel, with the interconnecting fins between said end tubes and said immediately adjacent tubes extending below said short fixing members, but not thereabove.

The invention preferably includes at least one of the following characteristics:

the fins are added-on vertical elements which are welded on either side to the adjacent tubes;

the fins are vertical elements deposited by direct metal melting between two adjacent tubes;

the fins are formed by welding together facing ribs on adjacent tubes;

the portion of the fins between the end tubes and the nearest adjacent tubes is split in the zone closest to the fixing members; and/or the bottoms of the splits in said zones are formed by circular holes of greater diameter than the width of the corresponding split.

According to a first method of manufacturing a panel in accordance with the invention, two or more tube circuits are separately formed having looped ends, the circuits are interfitted, vertical elements are disposed between adjacent tubes, and these elements are then welded to the adjacent tubes by means of a welding machine moving in translation along the tubes.

According to another method of manufacturing said panel, straight lengths of tube are assembled side by side, fins are formed between said tubes, and then interconnecting loops are welded to their ends.

The fins may be formed either:

by placing vertical elements between the straight tubes and then welding these elements on either side to the adjacent tubes; or by depositing these fins by direct metal melting between the tubes; or by assembling straight tubes fitted with ribs extending in a diametral plane side by side and then welding the ribs to one another.

BRIEF DESCRIPTION OF THE DRAWINGS

Embodiments of the invention are described by way of example with reference to the accompanying drawings, in which.

MORE DETAILED DESCRIPTION

Figure 1:
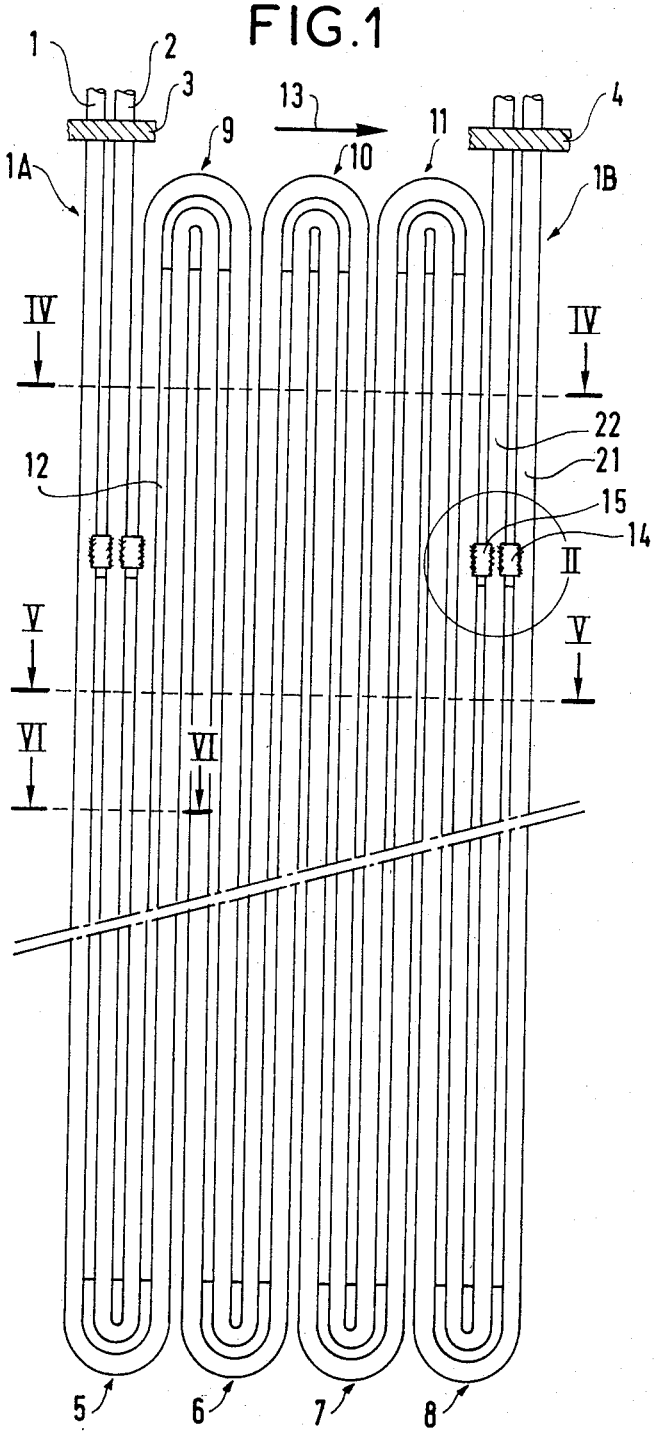
FIG. 1 an elevation of a panel assembly.

FIG. 1 shows a heat exchanger panel for use in a boiler for recovering waste heat by incinerating papermaking black liquor or household waste. In the figure, the heat exchanger panel comprises two sinuous tubes 1, 2 which are close to each other and whose convolutions are interfitting. The spacing between these tubes has been exaggerated for increased clarity. The tubes are suspended by their inlet ends 1A and their outlet ends 1B from fixed structures 3 and 4. For example, for tubes having an outside diameter of 51 mm, the pitch (the spacing between their axes) is 60 or 63 mm. The bottoms of these tubes have loops 5, 6, 7 and 8, and the tops of these tubes have loops 9, 10, and 11. The tubes 1 and 2 are interconnected over the major portion of their height by a fin 12.

Figure 2:
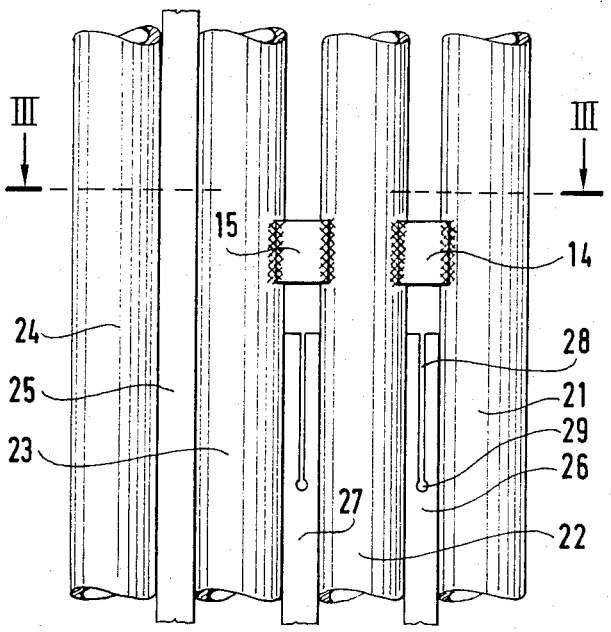
FIG. 2 shows a detail II of FIG. 1.
Figure 3:
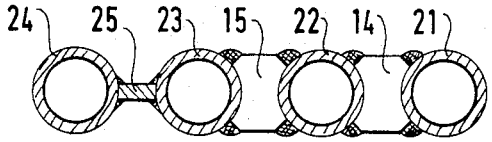
FIG. 3 is a section of a line III—III of FIG. 2.

In order to prevent the forces due to possible differential expansion in the direction shown by arrow 13 between the panel and its suspension system from applying excessive stresses to the top ends of the junction fin between the end lengths of the tubes connected to the fixed suspension structures and between these tubes and the adjacent length of tube, the two end lengths of tube and the adjacent length are interconnected by fixing elements 14, 15 which are welded along generator lines of adjacent tubes. These elements are shown to a larger scale in FIGS. 2 and 3 which correspond to detail II of FIG. 1. The element 14 connects the end lengths of tube 21 and 22, and the element 15 connects the length 22 with the adjacent length 23 of the panel. These panels may include two paths as shown in FIG. 1, but they may also include just one, or else three or four such paths.

The junction fin elements 26, 27 (whose width has been exaggerated for increased clarity) stop a little below the elements 14 and 15. In order to make the link between the lengths of tube flexible, the upper zone of the fins include a split such as 28 which terminates in a circular hole 29 in order to avoid the propagation of cracks. Thus, stresses due to differential expansion are transmitted by the parts 14 and 15 and are dissipated in the panel assembly.

In contrast, the tube lengths 23 and 24, and all the lengths in the central portion of the panel are fixed together by continuous fins 25.

Figure 4:
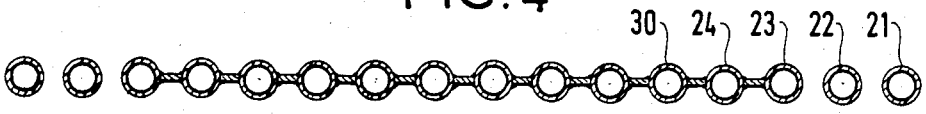
FIGS. 4 and 5 are sections on lines IV—IV and V—V respectively of FIG. 1.
Figure 5:
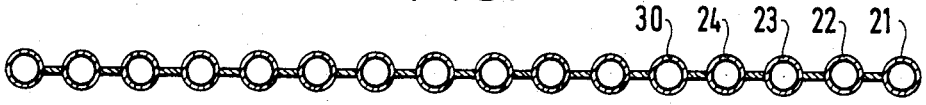

FIG. 4 is a section on a horizontal plane through the upper portion of the panel, above the level of the hollow fixing elements 14 and 15. The tube lengths 21, 22 and 23 are separate from one another, whereas the lengths 23, 24, 30, and so on, are interconnected by fins.

Figure 6:
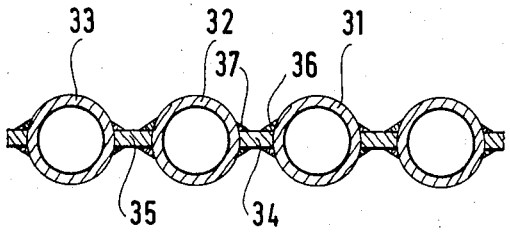
FIGS. 6, 7 and 8 are sections on line VI—VI of FIG. 1 showing three variants of fin constitution, respectively.
Figure 7:
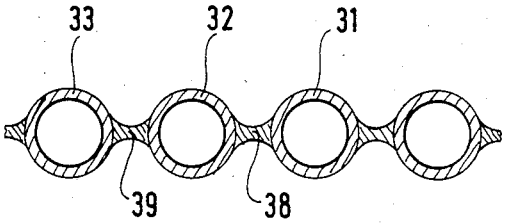
Figure 8:
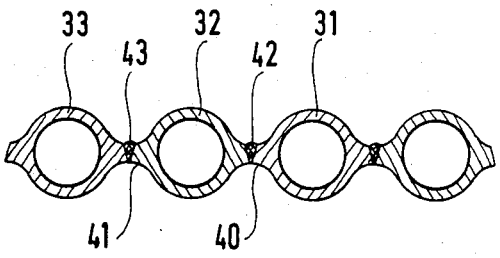

FIGS. 6, 7, and 8 show three variants of fin constitution for joining tube lengths. These figures correspond to a section on line VI—VI of FIG. 1.

FIG. 6 shows a junction fin formed by vertical strips 34, 35 which are added on and welded along each side to the tubes 31, 32, 33, along weld lines such as 36 and 37. The tubes may already include their end loops and may already be located in interfitting relationship, or else the end loops may be welded to the ends of the lengths of tube after the fins have been put into place. In the latter case, a welding machine may move along the axes of the tubes.

FIG. 7 shows junction fins 38, 39 formed by a deposit of molten metal between the adjacent tube lengths 31, 32, 33 performed by means of a fixed automatic machine through which the tubes move. The end loops are welded on subsequently to the ends of the tube lengths.

FIG. 8 shows junction fins 40, 41 formed by welding together tubes 31, 32, 33 which are provided with ribs in a diametral plane. In this case, as above, the ribs are welded together by a fixed machine. The end loops are welded on subsequently.

A heat exchanger panel in accordance with the invention is more particularly applicable to waste boilers for recovering heat by incinerating papermaking black liquor or household waste, but it is usable in any case where heat is to be exchanged between a fluid to be heated or boiled which flows inside the tubes and gas or vapor which is laden with solid particles and which flows around the tubes.

What is claimed is:

1. In a heat exchanger panel comprising; a plurality of vertical tubes interconnected alternately by top loops and by bottom loops to extend in a sinuous path from an inlet to an outlet, the improvement comprising: means fixed to said inlet and outlet of said vertical tubes for suspending said panel from a rigid structure solely via said inlet and said outlet, and wherein tubes come into contact via their outer surfaces with a soot-laden gas and are subject to differential thermal expansion from the inlet to the outlet, adjacent vertical tubes being separated from one another at a pitch which is a little greater than their diameter and being laterally interconnected by longitudinal fins, and wherein short fixing members are welded on either side to adjacent tubes at a level which is below the level of the top loops of the panel to fix the end ones of said tubes which are directly suspended from said rigid structure to one another and to the immediately adjacent tube with is not directly suspended thereby, with the interconnecting fins between said end tubes and said immediately adjacent tubes extending below said short fixing members, but not thereabove.

2. A panel according to claim 1, wherein the fins comprise added-on vertical elements welded on either side to adjacent tubes.

3. A panel according to claim 1, wherein the fins comprise vertical elements deposited by direct metal melting between two adjacent tubes.

4. A panel according to claim 1, wherein the fins are formed by welding together facing ribs on adjacent tubes.

5. A panel according to claim 1, wherein the portion of the fins between the end tubes and the nearest adjacent tubes is split in the zone closest to the fixing members forming a split therein.

6. A panel according to claim 5, wherein the bottoms of the splits in said zones are formed by circular holes of greater diameter than the width of the corresponding split.

* * * * *